United States Patent [19]

Fögelström

[11] 3,967,686

[45] July 6, 1976

[54] DEVICE FOR GUIDING A DRILL TOOL

[76] Inventor: Gosta Fögelström, 9 Nackanasparken, 131 00 Nacka, Sweden

[22] Filed: May 19, 1975

[21] Appl. No.: 578,609

Related U.S. Application Data

[63] Continuation of Ser. No. 423,002, Dec. 10, 1973.

[30] Foreign Application Priority Data

Dec. 13, 1972 Sweden ..... 16242/72

[52] U.S. Cl. ..... 173/22; 173/38; 308/3.9

[51] Int. Cl.[2] ..... E21C 11/02; E21C 5/00

[58] Field of Search ..... 173/1, 22, 38–44; 308/3.9; 175/220; 61/63

[56] References Cited

UNITED STATES PATENTS

| | | | |
|---|---|---|---|
| 2,244,127 | 6/1941 | Smith, Jr. | 308/3.9 |
| 2,514,832 | 7/1950 | Benson | 173/40 |
| 2,734,723 | 2/1956 | Larcen | 308/3.9 |
| 2,828,137 | 3/1958 | Wagner | 173/22 |
| 3,240,278 | 3/1956 | Witwer | 173/22 |
| 3,516,183 | 6/1970 | Serota | 175/220 |
| 3,612,190 | 10/1971 | Wills | 308/3.9 |
| 3,842,610 | 10/1974 | Willis et al. | 173/38 |

*Primary Examiner*—James A. Leppink
*Attorney, Agent, or Firm*—Eric Y. Munson

[57] ABSTRACT

A device for applying the drill tool displaceably carried by the feed beam of a vehicle supported drilling machine to a rock surface located at a distance from the feed beam. The drill tool is held in position during the collaring of the drill hole by a drill guide carried by a maneuverable arm mounted on the vehicle separately from the feed beam, and which drill guide is moved into engagement with the drill tool in close proximity to the rock surface. After the drill tool has penetrated into the rock surface a distance sufficient to be supported by the drill hole, the drill guide is released by a hydraulic device and withdrawn from the drill tool by the maneuverable arms.

3 Claims, 6 Drawing Figures

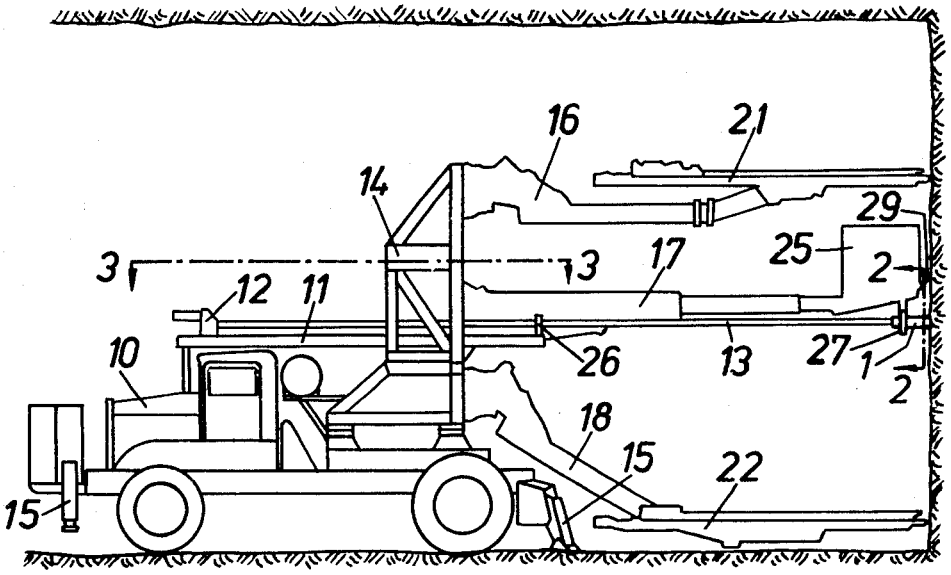
Fig. 1
Fig. 2
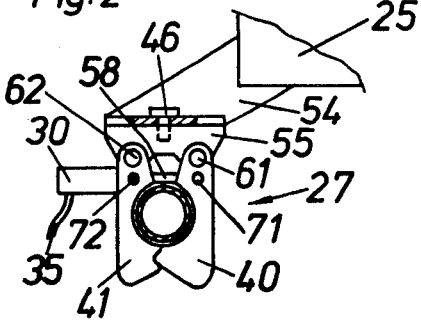
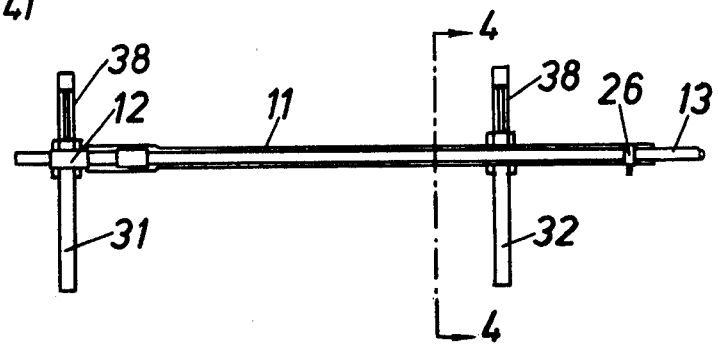
Fig. 3

DEVICE FOR GUIDING A DRILL TOOL

This is a continuation of application Ser. No. 423,002, filed 12/10/73.

SUMMARY OF THE INVENTION

The present invention relates to a device for applying a drill tool connected to a vehicle mounted drilling machine against a surface. The invention is primarily designed to be used for tunnelling or similar rock drilling work.

The invention is mainly characterized by the use of a drill guide mounted on a maneuverable arm carried by a vehicle for supporting and guiding the drill tool at the surface during the so-called operation.

BRIEF DESCRIPTION OF THE DRAWING

The invention is described below with reference to the 10 accompanying drawings in which FIG. 1 shows a side view of a drill rig for tunnelling.

FIG. 2 is a fractional view taken along the line 2—2 in FIG. 1.

FIG. 3 is a fractional view taken along the line 3—3 in FIG. 1.

DESCRIPTION OF THE EMBODIMENTS OF THE INVENTION

Figure 4:
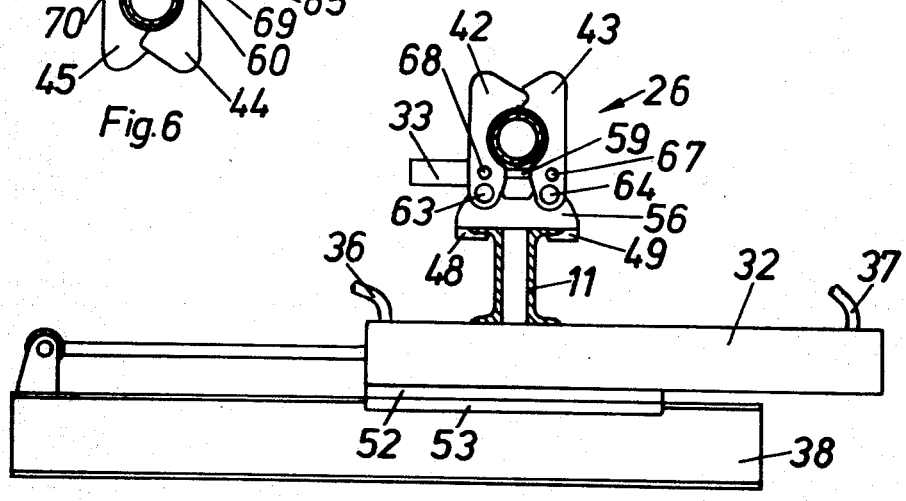
FIG. 4 is a view taken along the line 4—4 in FIG. 3 drawn to a larger scale.

The drill rig shown in FIG. 1 comprises a vehicle 10 which can be raised above the ground by means of jacks 15. A frame 14 is mounted on the vehicle. The frame carries a number of hydraulic arms 16, 17, 18. The arms 16, 18 carry drilling aggregates 21, 22 each of which comprises a rock-drilling machine and a feed device associated therewith. The arm 17 carries a platform 25 meant to be used when the drill holes are charged with explosive. The platform is suitably provided with a peg 29 which is pressed against the rock when the present invention is practiced. Two beams 38 (FIGS. 3 and 4) are mounted on the vehicle 10. These beams carry a feed beam 11 via hydraulic cylinders 31, 32 guided by plates 52, 53. A drilling machine 12 with a drill tool 13 connected thereto is displaceably arranged on the feed beam. The drill tool, which is meant for drilling the so-called large-hole is preferably provided with a down-the-hole drill 1. The feed beam 11 can be moved relatively to the vehicle 10 by supplying hydraulic fluid to conduits 36 or 37. A drill guide 26 is mounted at the front end of the feed beam 11 by means of plates 48, 49. The drill guide 26 comprises a joint 56, two jaws 42, 43 which are connected to the joint by means of hinges 63, 64 and a hydraulic cylinder 33 for maneuvering the jaws. The hydraulic cylinder is connected to the jaw 42 by means of a pin 68. The piston rod 59 of the hydraulic cylinder is connected to the jaw 43 by means of a pin 67.

A drill guide 27 (FIG. 2) is pivotally connected to an extension 54 on the platform 25 by means of a pivot 46. The drill guide 27 suitably has the same construction as the drill guide 26 and comprises a joint 55, jaws 40, 41, a hydraulic cylinder 30 with a piston rod 58, hinges 61, 62, and pins 71, 72. The jaws 40, 41 are moved into the position shown in FIG. 2 by supply of hydraulic fluid through the conduit 35.

Figure 5:
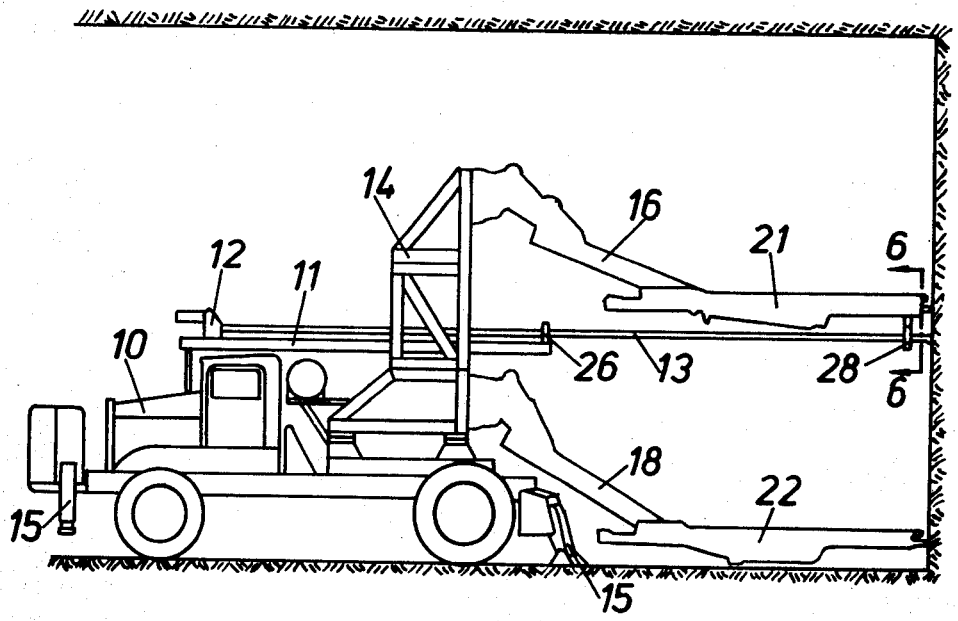
FIG. 5 shows a second embodiment of the invention.
Figure 6:
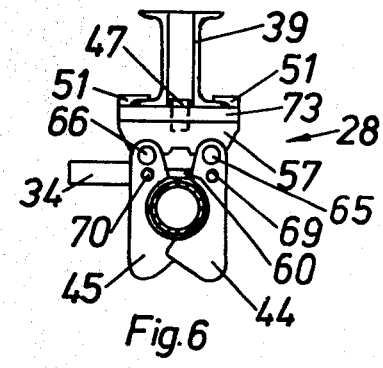
FIG. 6 is a fractional view taken along the line 6—6 in FIG. 5.

In the embodiment according to FIG. 5 the drill guide 27 has been replaced by a drill guide 28. This drill guide is by means of a pivot 47 (FIG. 6) swingably connected to a plate 73. The plate 73 is by means of plates 51 connected to the feed beam 39 of the drilling aggregate 21. The drill guide 28 is suitably built up as the drill guide 26 and comprises a joint 57, jaws 44, 45, a hydraulic cylinder 34 with a piston rod 60, hinges 65, 66, and pins 69, 70.

The drill rigs work in the following manner. The drill guide 27 or 28 is brought into engagement with the drill tool 13 by maneuvering the arm 17 or 16 for guiding the drill tool at the rock surface during collaring. When the drill tool 13 has penetrated into the rock face so far that it is guided by the drill hole, the hydraulic cylinder 30 or 34 is unloaded thereby the jaws 40, 41 or 44, 45 are brought apart. The drill guide 27 or 28 is thereafter moved away from the drill tool 13 by maneuvering the arm 17 or 16. This produces the advantage that the drilling aggregates 21, 22 can be used for drilling close up to the so-called large-hole at the same time as the latter is being drilled.

The above described and in the drawings shown embodiments of the invention are only to be regarded as examples which can be modified within the scope of the subsequent claims.

What I claim is:

1. In a drill rig supporting vehicle including a frame supporting a drilling machine having a feed beam mounted on the vehicle frame, a drill tool connected to the drilling machine and displaceably carried on the feed beam, the feed beam being movable relative to the vehicle frame and a drill guide means for guiding the drill tool, the improvement in the drill guide means enabling guiding of the tool at a substantial distance from the feed beam during collaring of a drill hole comprising a maneuverable arm mounted on the vehicle frame independent of the feed beam, the maneuverable arm being arranged to move separately relative to the feed beam, and a drill guide connected to the maneuverable arm at a location extending a distance from the feed beam, the drill guide being cooperatively arranged to selectively guide the drill tool proximate its drilling end during collaring of a drill hole and being mounted on a platform carried by said maneuverable arm, at least one drilling aggregate carried on the vehicle frame, the drilling aggregate having a drilling machine operatively associated therewith and the drilling aggregate being structurally adapted to drill in proximity to the drill tool after the drill hole has been collared without interferance of the feed beam.

2. In a drill rig supporting vehicle including a frame supporting a drilling machine having a feed beam mounted on the vehicle frame, a drill tool connected to the drilling machine and displaceably carried on the feed beam, the feed beam being movable relative to the vehicle frame and a drill guide means for guiding the drill tool, the improvement in the drill guide means enabling guiding of the tool at a substantial distance from the feed beam during collaring of a drill hole comprising a maneuverable arm mounted on the vehicle frame independent of the feed beam, the maneuverable arm being arranged to move separately relative to the feed beam, and a drill guide connected to the maneuverable arm at a location extending a distance from the feed beam, the drill guide being cooperatively arranged to selectively guide the drill tool proximate its drilling end during collaring of a drill hole, at least one drilling aggregate carried by the maneuverable arm, the drilling aggregate having a drilling machine operatively associated therewith and being adapted to drill in proximity to the drill tool.

3. The improved drill rig supporting vehicle as claimed in claim 2 wherein the drill guide is mounted on the drilling aggregate.

* * * * *